US006421014B1

(12) United States Patent
Sanad

(10) Patent No.: US 6,421,014 B1
(45) Date of Patent: Jul. 16, 2002

(54) COMPACT DUAL NARROW BAND MICROSTRIP ANTENNA

(76) Inventor: Mohamed Sanad, 5830 Lindsay Dr., Reno, NV (US) 89523

( * ) Notice: Subject to any disclaimer, the term of this patent is extended or adjusted under 35 U.S.C. 154(b) by 0 days.

(21) Appl. No.: 09/686,131

(22) Filed: Oct. 10, 2000

Related U.S. Application Data

(60) Provisional application No. 60/158,767, filed on Oct. 12, 1999.

(51) Int. Cl.[7] ..... H01Q 1/38

(52) U.S. Cl. ..... 343/700 MS; 343/833; 343/846

(58) Field of Search ..... 343/700 MS, 702, 343/815, 816, 817, 818, 833, 834, 846

(56) References Cited

U.S. PATENT DOCUMENTS 4,370,657 A * 1/1983 Kaloi ..... 343/700 MS
5,420,596 A * 5/1995 Burrell et al. ..... 343/700 MS
5,486,836 A 1/1996 Kuffner et al.
5,526,003 A 6/1996 Oqawa et al.
5,627,550 A * 5/1997 Sanad ..... 343/700 MS
5,703,600 A 12/1997 Burrell et al.
5,801,660 A 9/1998 Ohtsuka et al.
5,828,345 A 10/1998 Waterman et al.
5,850,198 A 12/1998 Lindenmeier et al.
5,917,450 A 6/1999 Tsunekawa et al.
5,926,137 A 7/1999 Nealy
5,926,139 A 7/1999 Korisch
5,929,812 A 7/1999 Aminzadeh
5,929,813 A 7/1999 Eggleston
5,943,015 A * 8/1999 Webb ..... 343/700 MS
5,943,020 A 8/1999 Liebendoerfer et al.
5,952,971 A 9/1999 Strickland
5,955,994 A 9/1999 Staker et al.
5,986,606 A 11/1999 Kossiavas et al.
5,995,047 A 11/1999 Freyssinier et al.

* cited by examiner

*Primary Examiner*—Tan Ho
(74) *Attorney, Agent, or Firm*—Ancel W. Lewis, Jr.

(57) ABSTRACT

A compact dual narrow band microstrip antenna particularly suited for remote wireless metering includes a dielectric, a directly fed radiating element, a parasitic radiating element gap coupled to the directly fed radiating element and a truncated ground plane. Each radiating element is partially shorted to the ground plane and each radiating element has a reactance window to lengthen the current path. The reactance window and partial shorting reduce the size of the each radiating element. The antenna is compact with good isotropic characteristics and sensitivity to two perpendicular polarizations.

14 Claims, 2 Drawing Sheets

COMPACT DUAL NARROW BAND MICROSTRIP ANTENNA

This application claims the benefit under 35 U.S.C. § 119(e) of the U.S. provisional patent application No. 60/158,767 filed Oct. 12, 1999.

TECHNICAL FIELD

The present invention relates to antennas and more particularly to a compact dual narrow band microstrip antenna that is particularly suited for wireless meter applications.

1. Background Art

Systems for wireless meter applications are often positioned beside buildings in urban areas and are subject to multipath reflections from other buildings. The portable reading equipment for such systems may be randomly oriented causing rotation of polarization. An antenna for a wireless meter application should be sensitive to two perpendicular orientations with good isotropic characteristics.

2. Disclosure of the Invention

A compact dual band microstrip antenna having a dielectric with a directly fed first radiating element and a spaced, coplanar, parasitic second radiating element on a first side of the dielectric, and a ground plane on an opposite second side of the dielectric is disclosed. Each radiating element has a reactance window and each radiating element is partially shorted to the ground plane by a plurality of spaced shorting posts extending through the dielectric. A uniform gap of a selected width separates the radiating elements. A feed point in the form of a hole extending through the dielectric connects to the directly fed radiating element near the gap. An opening is provided around the feed point on the side of the dielectric with the ground plane to electrically isolate the feed point from the ground plane. The ground plane is truncated.

BRIEF DESCRIPTION OF THE DRAWINGS

Details of this invention are described in connection with the accompanying drawings that bear similar reference numerals in which.

DETAILED DESCRIPTION OF THE INVENTION

Figure 1:
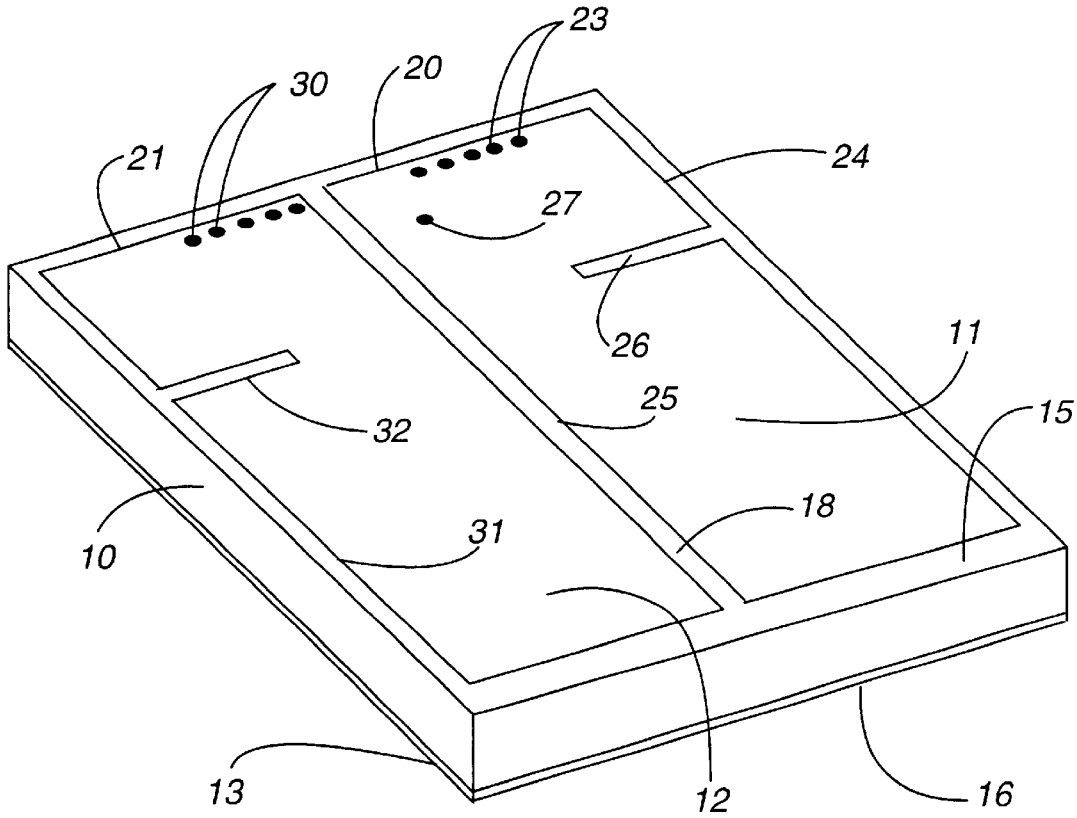
FIG. 1 is a perspective view of an antenna embodying features of the present invention.
Figure 2:
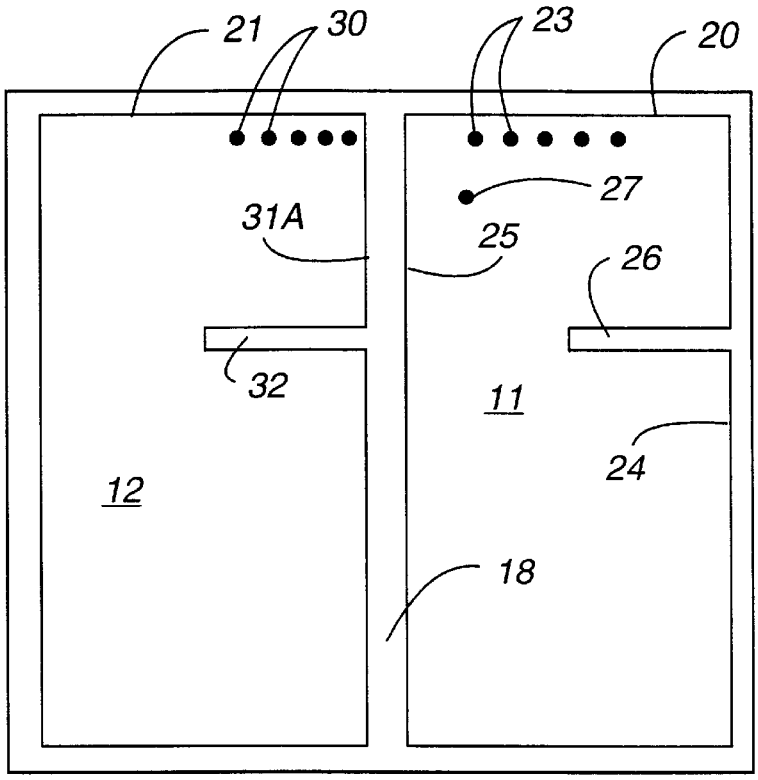
FIG. 2 is a top plan view of the antenna of FIG. 1 with an alternative arrangement of the second radiating element.
Figure 3:
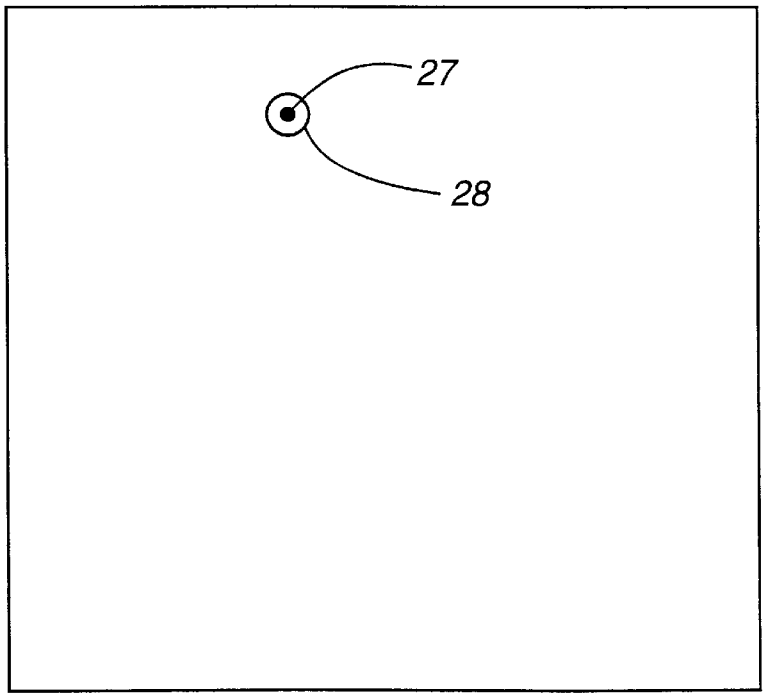
FIG. 3 is a bottom plan view of the antenna of FIG. 1.

Referring now to FIGS. 1, 2 and 3 the compact antenna embodying features of the present invention includes a dielectric 10, a directly fed first radiating element 11, a parasitic second radiating element 12 and a ground plane 13. The dielectric 10 is in the form of a thin, flat substrate that is generally planar with a rectangular outline, and includes a planar first side 15 and a spaced, oppositely facing planar second side 16. Preferably the dielectric 10 has a square outline. The ground plane 13 is disposed over the entire second side 16 of the dielectric 10 and is truncated, having an area approximately equal to the combined area of the first and second radiating elements 11 and 12.

The first and second radiating elements 11 and 12 are made of conductive material and are each generally rectangular. The first and second radiating elements 11 and 12 are disposed in a side by side arrangement on the first side 15 of the dielectric 10 and are separated by a uniform gap 18. The first radiating element 11 has a first edge 20 extending transverse to the gap 18 and the second radiating element has a first edge 21 extending transverse to the gap 18, with the first edges 20 and 21 of the first and second radiating elements 11 and 12 being substantially co-linear.

The first edge 20 of the first radiating element 11 is partially shorted to the ground plane 13 by a first means that includes, in the illustrated embodiment, a plurality of uniformly spaced first shorting posts 23. The first edge 20 of the first radiating element 11 is considered to be partially shorted because only a portion of the first edge 20 of the first radiating element 11 is connected to the ground plane 13 instead of the entire first edge 20 of the first radiating element 11. Each first shorting post 23 is a plated though hole extending through the dielectric 10 and connected to the ground plane 13 and the first radiating element 11. The first shorting posts 23 are arranged linearly along and as close as possible or in close proximity to the first edge 20 of the first radiating element 11. The first shorting post 23 that is nearest to the gap 18 is spaced away the gap 18 by a selected distance so that the plurality of first shorting posts 23 is substantially centered along the first edge 20 of the first radiating element 11. The first means for partially shorting may alternatively include conductive tape or a tab extending around the dielectric 10 from the first edge 20 of the first radiating element 11 to the ground plane 13.

The first radiating element 11 has a second edge 24, connected to the first edge 20 and extending transverse therefrom, opposite and parallel to the gap 18. The first radiating element 11 has a third edge 25, connected to the first edge 20 and extending transverse therefrom, adjacent to the gap 18 and parallel to the second edge 24. A reactance window 26, in the form of a narrow rectangular strip cut into the first radiating element 11, extends parallel to and spaced from the first edge 20, opening through and extending inward from the second edge 24 towards the third edge 25 of the first radiating element 11. The first radiating element 11 includes a feed point 27 between the first edge 20 and the reactance window 26 spaced from the first edge 20 a selected distance and spaced a selected distance from the third edge 25.

The feed point 27 is preferably located at a selected distance from the first edge 20 that is about half the distance from the first edge 20 to the reactance window 26. The feed point 27 is located at a distance from the third edge 25 that is selected provide an impedance match and is preferably is less than half the distance from the third edge 25 to the second edge 24. In the illustrated embodiment the feed point 27 is located a selected distance from the third edge 25 that is about one fourth the distance from the third edge 25 to the second edge 24. In the illustrated embodiment the feed point 27 includes a plated through hole through the dielectric 10. The feed point 27 may include a non-plated hole instead of the plated through hole. The ground plane 13 has an opening 28 around the feed point 27 on the second side 16 of the dielectric 10 so that the feed point 27 is electrically isolated from the ground plane 13. A coaxial cable (not shown) may be attached to the antenna with the center conductor of the coaxial cable connecting to the feed point 27 at the second side 16 of the dielectric 10 and the outer conductor of the coaxial cable connecting to the ground plane 13.

The first edge 21 of the second radiating element 12 is partially shorted to the ground plane 13 by a second means that includes, in the illustrated embodiment, a plurality of uniformly spaced second shorting posts 30. Each second shorting post 30 is a plated though hole extending through the dielectric 10 and connected to the ground plane 13 and the second radiating element 12. The second shorting posts 30 are arranged linearly along and as close as possible or in close proximity to the first edge 21 of the second radiating element 12. The second shorting post 30 that is nearest to the gap 18 is adjacent the gap 18 with the remaining second shorting posts 30 spaced at intervals therefrom. The second means for partially shorting may alternatively include conductive tape or a tab extending around the dielectric 10 from the first edge 21 of the second radiating element 12 to the ground plane 13.

The second radiating element 12 includes a second edge 31 connected to the first edge 21 and extending transverse therefrom, and a reactance window 32 opening through and extending inward from the second edge 31, parallel to and spaced from the first edge 21 of the second radiating element. As shown in FIG. 1, the second edge 31 of the second radiating element 12 may be opposite the gap 18 or as shown in FIG. 2, the second edge 31A of the second radiating element 12 may be adjacent the gap 18.

By way of example, and not a limitation, an antenna as described above can be dimensioned as follows for the cellular frequency bands of 834–836 MHz and 879–881 MHz. The dielectric 10 and the ground plane 13 each have a length of 48 mm and a width of 48 mm. The dielectric is 3 mm thick. The first radiating element 11 is 22 mm wide and the second radiating element 12 is 20 mm wide, and the first and second radiating element are both either 43 or 44 mm long. The gap 18 is 2 mm wide. There are five first shorting posts 23, each 1 mm in diameter, with the first shorting post 23 nearest the gap 18 being spaced 6 mm from the gap 18 and the remaining first shorting posts being spaced at intervals of about 3 mm. The reactance window 26 in the first radiating element 11 is spaced 12 mm from the first edge 20, extends inward 12 mm from the second edge 24 and is 1 mm wide. The feed point 27 is 1.4 mm in diameter, and is spaced 5 or 6 mm from the first edge 20 and 5 mm from the third edge 25 of the first radiating element 11. There are five second shorting posts 30, each 1 mm in diameter, spaced at intervals of about 2.5 mm. The reactance window 32 in the second radiating element 12 is spaced 12 mm from the first edge 21, extends inward 10 mm from the second edge 31 and is 1 mm wide. The opening 28 in the ground plane 13, around the feed point 27 is 2.8 mm in diameter.

The antenna may be constructed of FR4 or any other adequate substrate material. An exemplary material is MC3D Medium Frequency Laminate from GIL technologies, Collierville, Ten., with a dielectric constant of about 3.86.

The first radiating element 11 is directly fed or driven by the feed point 27 and the second radiating element 12 is gap coupled to the first radiating element 11 and thereby parasitically fed. The partial shorting of the first and second radiating elements 11 and 12 to the ground plane 13 reduces the size of each element. The reactance windows 26 and 32 in the first and second radiating elements 11 and 12 each lengthen the current path and thereby reduce the size of each element. The reactance windows 26 and 32 in the first and second radiating elements 11 and 12 also increase the amount of diffracted waves, which improves the isotropic characteristics of the antenna and helps make the antenna sensitive to two perpendicular linear polarizations. The truncation of the ground plane 13 reduces the antenna size and improves the isotropic characteristics. The location of the feed point 27 near the gap 18, the location of the first shorting posts 23 spaced away from the gap 18 and the location of the second shorting posts 30 adjacent the gap 18 increase the antenna efficiency.

Although the present invention has been described with a certain degree of particularity, it is understood that the present disclosure has been made by way of example and that changes in details of structure may be made without departing from the spirit thereof.

What is claimed is:

1. A compact antenna comprising:

a dielectric having a first side and a spaced, oppositely facing second side, a directly fed first radiating element on said first side, said first radiating element having a first edge and a second edge adjacent to and extending transverse to said first edge, said first radiating element including a reactance window spaced from said first edge and opening through and extending inward from and transverse to said second edge, a parasitic second radiating element on said first side arranged side by side with said first radiating element, said second radiating element being separated from said first radiating element by a gap, said second radiating element having a first edge and a second edge adjacent to and extending transverse to said first edge, said second radiating element including a reactance window spaced from said first edge and extending inward from and transverse to said second edge, a ground plane on said second side, first means, connected between said first edge of said first radiating element and said ground plane, for partially shorting said first radiating element to said ground plane, and second means, connected between said first edge of said second radiating element and said ground plane, for partially shorting said second radiating element to said ground plane.

2. The antenna of claim 1 wherein said ground plane is truncated.

3. The antenna of claim 1 wherein said first edge of said first radiating element extends transverse said gap and said first means includes a plurality of uniformly spaced first shorting posts each extending through said dielectric from said ground plane to said first radiating element, said first shorting posts being generally linearly disposed along said first edge of said first radiating element.

4. The antenna of claim 3 wherein said plurality of first shorting posts are spaced a selected distance from said gap.

5. The antenna of claim 1 wherein said first edge of said second radiating element extends transverse said gap and said second means includes a plurality of uniformly spaced second shorting posts each extending through said dielectric from said ground plane to said second radiating element, said second shorting posts being generally linearly disposed along said first edge of said second radiating element.

6. The antenna of claim 5 wherein said plurality of second shorting posts is located adjacent said gap.

7. The antenna of claim 1 wherein said second edge of said second radiating element is adjacent said gap with said reactance window of said second radiating element extending inward therefrom.

8. The antenna of claim 1 wherein said second edge of said second radiating element is opposite said gap with said reactance window of said second radiating element extending inward therefrom.

9. The antenna of claim 1 wherein said second edge of said first radiating element is opposite said gap with said reactance window of said first radiating element extending inward therefrom.

10. The antenna of claim 1 wherein said first radiating element includes a third edge opposite said second edge and a feed point, said feed point being located between said first edge and said reactance window and a selected distance from said third edge.

11. The antenna of claim 10 wherein said selected distance is less than half of the distance from said second edge to said third edge.

12. The antenna of claim 10 wherein said selected distance is about one fourth of the distance from said second edge to said third edge.

13. The antenna of claim 10 wherein said feed point includes a plated through hole extending through said dielectric and said ground plane includes an opening around said feed point on said second side of said dielectric to isolate said feed point from said ground plane.

14. A compact dual narrow band microstrip antenna with good isotropic characteristics and sensitivity to two perpendicular polarizations, and particularly suited for wireless meter applications comprising:

a dielectric having a first side and a spaced, oppositely facing second side, a directly fed first radiating element on said first side, said first radiating element having a first edge, a second edge adjacent to and extending transverse to said first edge and a third edge spaced from and opposite said second edge, said first radiating element including a reactance window spaced from said first edge and extending inward from and transverse to said second edge, said first radiating element including a feed point located between said first edge and said reactance window and a distance from said third edge that is about one fourth of the distance from said second edge to said third edge, a parasitic second radiating element on said first side arranged side by side with said first radiating element, said second radiating element being separated from said first radiating element by a gap with said third edge of said first radiating element adjacent said gap, said second radiating element having a first edge and a second edge adjacent to and extending transverse to said first edge, said second radiating element including a reactance window spaced from said first edge and extending inward from and transverse to said second edge, a ground plane on said second side, said feed point including a plated through hole extending from said first radiating element through said dielectric to said second side with said ground plane including an opening around said feed point to isolate said feed point from said ground plane, a plurality of spaced first shorting posts each extending through said dielectric and connected from said ground plane to said first edge of said first radiating element for partially shorting said first radiating element to said ground plane, said first shorting posts being generally linearly disposed along said first edge of said first radiating element and spaced from said gap, and a plurality of spaced second shorting posts each extending through said dielectric and connected from said ground plane to said first edge of said second radiating element for partially shorting said second radiating element to said ground plane, said second shorting posts being generally linearly disposed along said first edge of said second radiating element adjacent said gap.

* * * * *